US005863035A

United States Patent [19]

Howell

[11] Patent Number: 5,863,035

[45] Date of Patent: Jan. 26, 1999

[54] PIPE JACK CLAMP

[76] Inventor: Dennis C Howell, 12566 Neptune, Pocatello, Id. 83202

[21] Appl. No.: 880,205

[22] Filed: Jun. 23, 1997

Related U.S. Application Data

[63] Continuation of Ser. No. 509,241, Jul. 31, 1995, abandoned.

[51] Int. Cl.[6] ..... B25B 1/10

[52] U.S. Cl. ..... 269/246; 269/258; 269/287; 269/902; 254/100; 254/133; 254/DIG. 4

[58] Field of Search ..... 254/100, 133, 254/DIG. 4; 269/DIG. 902, 43, 258, 246, 287

[56] References Cited

U.S. PATENT DOCUMENTS

| | | | |
|---|---|---|---|
| 2,108,077 | 2/1938 | Robinson | 269/902 |
| 2,364,150 | 12/1944 | Lowenstein | 269/902 |
| 2,371,831 | 3/1945 | Leming | 269/902 |
| 3,211,446 | 10/1965 | Headrick | 269/902 |
| 3,345,061 | 10/1967 | Schaefer | 269/902 |
| 4,139,189 | 2/1979 | Wietrzyk | 269/902 |
| 5,135,209 | 8/1992 | Penny | 269/902 |
| 5,280,891 | 1/1994 | Estes | 269/902 |

*Primary Examiner*—Robert C Watson

[57] ABSTRACT

A clamping device capable of engaging a pipe jack for securing a work piece thereon. This device includes a yoke adopted to slidably engage a V-configured pipe jack and further having a threaded orifice contained therein. Contained within the threaded orifice is a threaded stem. A handle is attached to an upper distal end of the threaded stem. Pivotally attached to a lower distal end of the threaded stem is a head for engaging a work piece.

4 Claims, 3 Drawing Sheets

PIPE JACK CLAMP

CROSS REFERENCE TO RELATED APPLICATIONS

This application is a continuation of the application Ser. No. 08/509,241 filed on Jul. 31, 1995 titled PIPE JACK CLAMP now abandoned.

BACKGROUND OF THE INVENTION

1. Field of the Invention

The present invention relates generally to a clamp device, more particularly, the present invention relates to a clamp device that can slidably engage a V-configured pipe jack securing a work piece thereon.

2. Description of Prior Art

Welders or pipe fitters often use a pipe jack which has a V-configuration for either welding or fabricating work pieces. In order to prevent injury, the work pieces are often secured to the pipe jack. The prior art does disclose a number of devices capable of clamping or securing work pieces such as pipes. A number of these devices are fairly complex employing a number of moving parts, which could make them cost prohibitive. Also, none of the prior art devices are specifically adapted to be used with a pipe jack and would not accomplish this task as affectively as the present invention. Therefore, there is a need for a simple device that is specifically adapted to engage a pipe jack securing a work piece thereon.

Numerous innovations for clamping devices have been provided in the prior art that are described as follows. Even though these innovations may be suitable for the specific individual purposes to which they address, they differ from the present invention as hereinafter contrasted.

U.S. Pat. No. 2,108,077 to Robinson discloses a pipe joint welding clamp consisting of a V-shaped angle iron and two yokes that each have one side rotatably mounted to one side of the angle iron. This patent differs from the present invention because a clamp device adapted to slidably engage a V-configured pipe jack is not disclosed and further having a V-shaped head to engage the work piece is not disclosed.

U.S. Design Pat. No. 137,413 to Tatro, U.S. Pat. No. 3,218,059 to Andrew, U.S. Pat. No. 4,139,189 to Wietrzyk and U.S. Pat. No. 4,861,011 to Varga each disclose a clamp that slidably engage a square work piece holder device, wherein contained on two opposing sides of the work piece holder are slots engaged by the clamp. This patent differs from the present invention because a yoke structure is not disclosed that would slidably engage a V-configured pipe jack and a V-shaped head structure is further not disclosed.

U.S. Pat. No. 2,788,686 to Holt, U.S. Pat. No. 3,625,503 to Hatt, U.S. Pat. No. 3,741,517 to Pogonowski U.S. Pat. No. 3,971,552 to Mayfield and U.S. Pat. No. 4,583,432 to Bricker each disclose a clamping device. Holt discloses a self centering work holding device consisting of an upper and lower jaw contained within a frame. Hatt discloses a work piece holder having opposed grabbing jaws, wherein the top jaw can moveably engage a work piece. Pogonowski discloses a clamping device consisting of a yoke having spaced apart arms, wherein each arm has a cross member for engaging a well casing. Mayfield discloses a pipe vise having a lower jaw secured to a base plate and a moveable upper jaw secured to the base plate. Bricker discloses a work piece holder consisting of a clamping subassembly which is centerable with respect to the centering member and secured thereon. These patents differ from the present invention because no structure is disclosed that could slidably engage a V-configured pipe jack for securing a work piece thereon.

In U.S. Pat. No. 5,327,486 by Headrick differs from the present invention because the Headrick patent reveals a plethora of functional limitations which include but are not limited to the following:

The Headrick patent claims a comprehensively different system than does the current invention. The Headrick patent is specifically designed to act as a cutting fixture, not a pipe jack clamp. In the Headrick patent, the yoke of the cutting fixture is adapted to slide on a V-configured support prior to anchoring the screw. Significantly, though, the screw of the cutting fixture lacks a rotatable V-shaped head. This significantly decreases the mobility of the apparatus and is a limitation of the Headrick patent's usefulness and value. The patent by Headrick is limited in that it does not take advantage of the embodiment present invention. The present invention is specifically configured so that it provides a clamp device adapted to slidably engage a V-configured pipe jack and further having a V-shaped head to engage the work piece. The V-shaped head in the present invention is pivotable, not fixed as in the Headrick patent.

As a result, the present invention provides a much higher degree of overall utility than does the Headrick patent, and will appeal to the vast amount of consumers who will want the benefits of a pipe jack clamp that allows pipes to be easily positioned when working or welding on a pipe jack, and that is easy to install, remove and operate, and that makes pipe fitting in the field more secure, safer, faster and accurate. The Headrick patent claims a comprehensively different system than does the current invention. The Headrick patent is specifically designed to act as a cutting fixture, not a pipe jack clamp. In the Headrick patent, the yoke of the cutting fixture is adapted to slide on a V-configured support prior to anchoring the screw. Significantly, though, the screw of the cutting fixture lacks a pivotable V-shaped head. This significantly decreases the flexibility of the apparatus and is a limitation of the Headrick patent's usefulness and value. The present invention is specifically configured so that it provides a clamp device adapted to slidably engage a V-configured pipe jack and further having a V-shaped head to engage the work piece. The V-shaped head in the present invention is pivotable, not fixed as in the Headrick patent.

In U.S. Pat. No. 5,488,575 by inventor Penny is limited as compared to the present invention due to the following features: the Penny patent is specifically designed as a pipe clamp apparatus. In the Penny patent, FIG. 6A discloses a swivel connection 24*b* to provide for the angular orientation of the V-configured bracket. While it is applicable for this specific but limited use, the patent as a whole constitutes a wholly different aspect of the complete present invention. The present invention is specifically configured so that it provides a clamp device adapted to slidably engage a V-configured pipe jack and further having a V-shaped head to engage the work piece. In addition, the V-shaped head in the present invention is pivotable, as the head (118) is pivotally attached to the lower distal end of the threaded stem (114). The present invention provides for a more secure means of pivoting the V-shaped head, which is desirable for the user as it keeps the work piece more steady, and is of a simpler more cost-effective configuration, adding to the benefits of the means embodied in the current invention. Such advantages are not found in the patent by Penny.

In contrast, the present invention is specifically configured so that it provides a clamp device adapted to slidably engage a V-configured pipe jack and further having a V-shaped head to engage the work piece. In addition, the V-shaped head in the present invention differs from the V-shaped bracket in the patent by Penny. Specifically, the patent by Penny is comprised of first and second plates, each of which contains recesses positioned medially of the first and second plate side edges. The present invention does not contain any such recesses within the plates of the V-shaped head. In fact, such an embodiment present in the patent by Penny would be limited as compared to the purpose of the present invention; in that it would diminish the gripping friction and surface tension embodied in the more complete plates of the V-shaped head in the present invention.

Numerous innovations for clamping devices have been provided in the prior art that are adapted to be used. Even though these innovations may be suitable for the specific individual purposes to which they address, they would not be suitable for the purposes of the present invention as heretofore described.

SUMMARY OF THE INVENTION

In according with the present invention, the pipe jack clamp consists of a yoke adapted to slidably engage a V-configured pipe jack. A threaded stem contained within a complimentary threaded portion of the yoke. The threaded stem having a handle at one end and a V-shaped head at the other end.

Broadly considered, the invention comprises a clamp device that can be easily slid onto a V-configured pipe stand containing a work piece. The clamp device can be positioned over the work piece where the threaded stem can be rotated downward causing the V-shaped head to engage the work piece, thereby securing the work piece within the pipe stand.

Accordingly, it is an object of the present invention to provide a clamping device.

More particularly, it is an object of the present invention to provide a pipe jack clamp.

In keeping with these objects, and with others which will become apparent hereinafter, one feature of the present invention resides, briefly stated, in that the pipe jack clamp can affectively and easily secure a work piece to a pipe stand.

When the pipe jack clamp is designed in accordance with the present invention, it allows pipes to be easily positioned when working or welding on a pipe jack.

In accordance with another feature of the invention, the pipe jack clamp is easy to install, remove and operate.

Another feature of the present invention is that it will make pipe fitting in the field more secure, safer, faster and accurate.

Yet another feature of the present invention is that multiple pipe jack clamps can be used on a long or complex fabrication.

Still another feature of the present invention is that the pipe jack clamp has a long useable life and is not easily damaged.

Another feature of the present invention is that the it is a modestly costing device.

Still yet another feature of the present invention is that the pipe jack clamp does not damage, mark, bend or scratch pipes.

Another feature of the present invention is that only requires a small storage place.

Still yet another feature of the present invention is that it is of a simple balanced design.

Another feature of the present invention is that when threaded stem is extended to firmly and securely engage the work piece, the cross member of the yolk is concurrently moved in an opposite and upward direction, thereby concurrently, squeezing inwardly the side members which more securely engages the lower side members to the V-configured pipe jack resulting in the entire system functioning as a single unit.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

FIRST EMBODIMENT

110 - first pipe jack clamp (110)
112 - first yoke (112)
112A - first yoke cross member (112A)
112B - first yoke boss (112B)
112C - first yoke side member (112C)
112D - first yoke lower side member (112D)
114 - first threaded stem (114)
116 - first handle (116)
118 - firsthead(118)
120 - first pipe jack (120)
122 - first work piece (122)
124 - second work piece (124)

SECOND EMBODIMENT

210 - second pipe jack clamp (210)
212 - second yoke (212)
212A - second cross member (212A)
212B - second boss (212B)
212C - second side member (212C)
212D - second lower side member (212D)
214 - second threaded stem (214)
216 - second handle (216)
218 - second head (218)
220 - second pipe jack (220)

DETAILED DESCRIPTION OF THE PREFERRED EMBODIMENT

Figure 1:
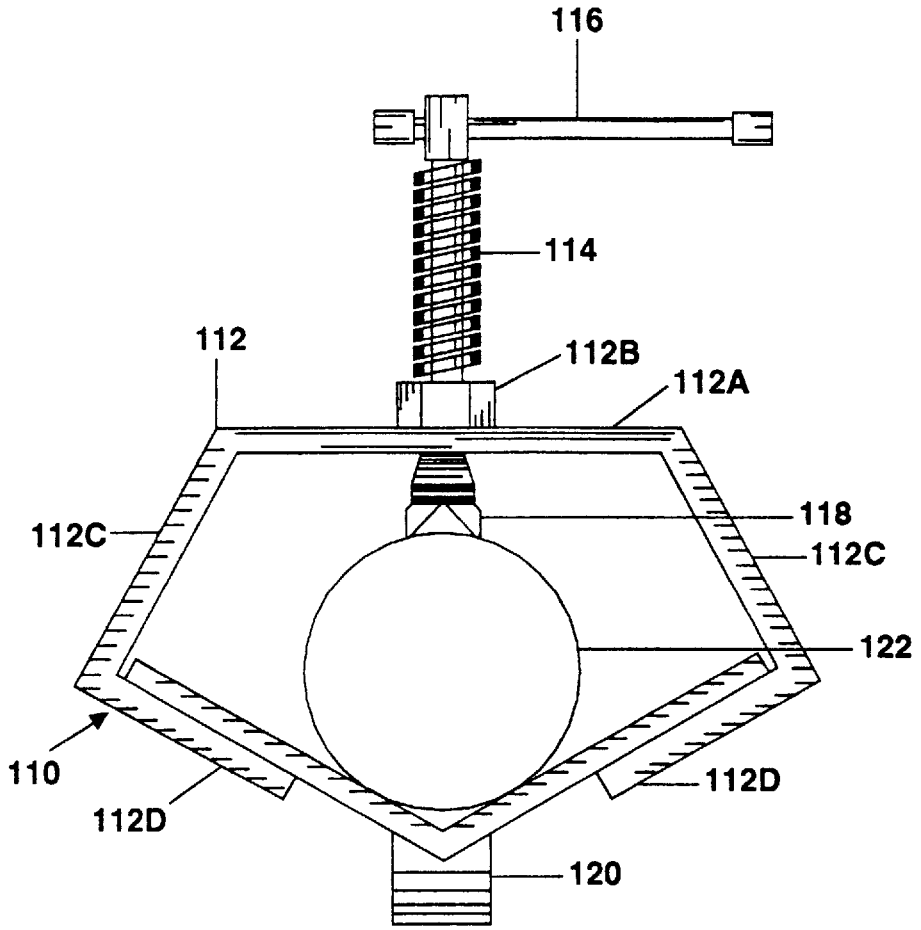
FIG. 1 is a front view of a first pipe jack clamp exhibiting a first work piece held in position between a first head and a first pipe jack.
Figure 2:
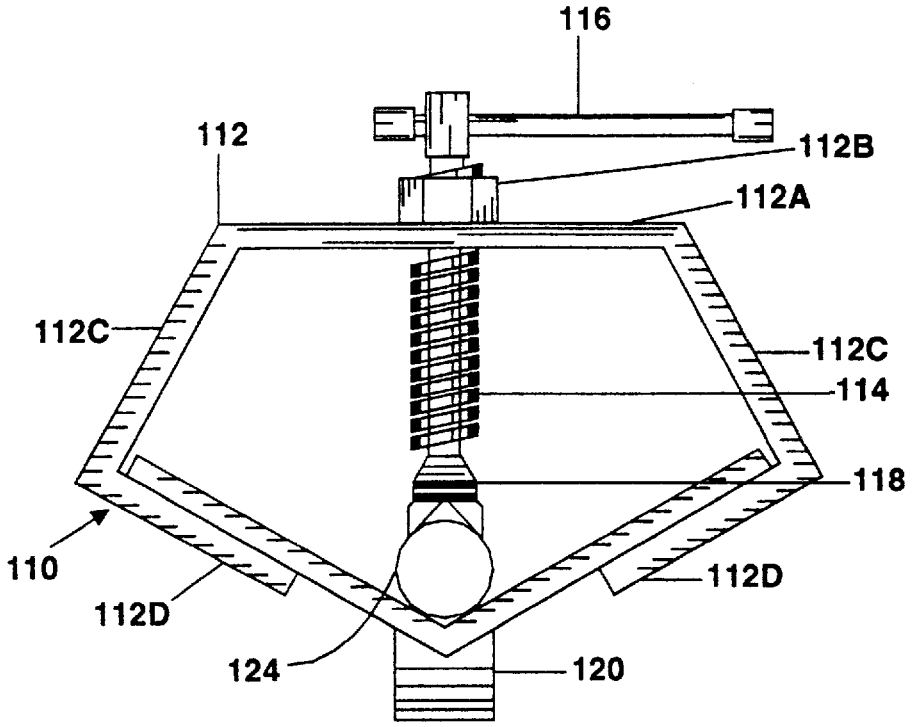
FIG. 2 is a front view of a first pipe jack clamp exhibiting a second work piece held in position between a first head and a first pipe jack.

Firstly, referring to FIG. 1 and FIG. 2 which are a front view of a first pipe jack clamp (110) exhibiting a first work piece (122) and second work piece (124), respectively, held in position between a first head (118) and a first pipe jack (120). The first pipe jack clamp (110) comprises a first yoke (112) which comprises a first yoke cross member (112A). The first yoke (112) further comprises a first yoke boss (112B) secured to an upper side middle of the first yoke cross member (112A). The first yoke boss (112B) and the first yoke cross member (112A) comprise a threaded opening therethrough. The first yoke (112) further comprises a pair of first yoke side members (112C) are each securely attached at opposite distal ends of the first yoke boss (112B) extending at an obtuse outward angle downwardly therefrom. The first yoke (112) further comprises a pair of first yoke lower side members (112D) are each securely attached at a distal end of each of the first yoke side members (112C) extending at a right inward angle downwardly therefrom.

The first pipe jack clamp (110) further comprises a first threaded stem (114) is engageably mounted within the threaded opening. The first threaded stem (114) further comprises a first handle (116) securely attached at an upper distal end thereto. A first head (118) is rotatably mounted on a bottom distal end of the first threaded stem (114). The first head (118) comprises a configuration to secure a work piece (122, 124) in place. The configuration is preferably a downward facing open V-shape.

The first pipe jack clamp (110) further comprises a first pipe jack (120) which comprises an upward V-configuration having complimentary configuration to an angle of the first yoke lower side members (112D). The first yoke (112) slidably engages the first pipe jack (120). A work piece (122, 124) is positioned between the first yoke (112) and first pipe jack (120). The work piece (122, 124) is further positioned on top of the first pipe jack (120) and directly under the first yoke boss (112B).

The first pipe jack clamp (110) is manufactured from a material selected from a group consisting of metal, metal alloy, rubber, rubber composite, plastic, plastic composite, fiberglass, epoxy, and carbon-graphite. The first pipe jack clamp (110) should not be fabricated from carbon steel when used around stainless steel pipe, because carbon steel can contaminate stainless steel. For other applications the first pipe jack clamp (10) can be fabricated from carbon steel.

The pair of obtuse angles preferably should be angles of approximately (120°) degrees, which is equal to the angle between the V-configured sides of the first pipe jack (120). The pair of (120°) degree angles ensure that the lower side of the first yoke lower side members (112D) are configured to form a pair of right angles with the pair of first yoke side members (112C), which is preferable.

The length of the pair of first yoke side members (112C) is determined by the diameter of the largest work piece to be secured by the first pipe jack clamp (110). The length of the pair of first yoke side members (112C) chosen must at least provide enough vertical clearance to fit a work piece with the maximum sized diameter, between the apex of the V-configured sides of the first pipe jack (120) and the first head (116) extended in a fully retracted position. The first embodiment of the first pipe jack clamp (110) is configured to secure a work piece having a maximum diameter of 3 inches, which is the diameter of the first work piece (122). The first pipe jack clamp (110) can be configured to secure any size work piece by varying the lengths of the pair of first yoke side members (112C).

During operation, a user will slide the first pipe jack clamp (110) onto one end of the first pipe jack (120), whereby the first yoke (112) slidably engages the V-configured sides of the first pipe jack (120) as shown in FIG. 1. The first pipe jack clamp (110) will be securely held to the first pipe jack (120), because of the unique design of the first yoke (112). Then the user will then slide the first pipe jack clamp (110) over the work piece and screw the first head (124) down engaging the work piece, thereby securing the work piece to the first pipe jack (120). Setting up work pieces with the first pipe jack clamp (110) is easier and more accurate because it does not have to be held in place when screwing down the work piece. The first pipe jack clamp (110) is already secured to the first pipe jack (120). While conventional clamps have to be held in place when screwing them down, which can slip causing injury or damage.

Figure 3:
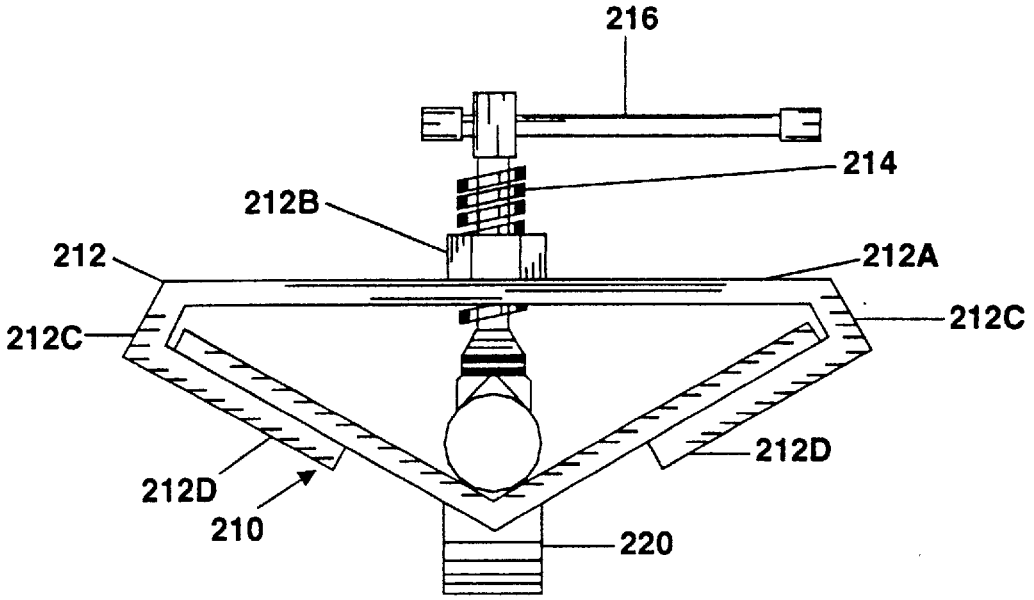
FIG. 3 is a front view of a second pipe jack clamp exhibiting a second work piece held in position between a second head and a second pipe jack.

Now referring to FIG. 3 which is a front view of a second pipe jack clamp (210) exhibiting a second work piece (124) held in position between a second head (218) and a second pipe jack (220). This is because the second pipe jack clamp (210) is designed to secure a work piece having a shorter maximum diameter. The maximum diameter work piece the second pipe jack clamp (210) can secure is approximately 1½ inches. The second pipe jack clamp (210) comprises a second yoke (212) which comprises a second yoke cross member (212A). The second yoke (212) further comprises a second yoke boss (212B) secured to an upper side middle of the second yoke cross member (212A). The second yoke boss (212B) and the second yoke cross member (212A) comprise a threaded opening therethrough. The second yoke (212) further comprises a pair of second yoke side members (212C) are each securely attached at opposite distal ends of the second yoke boss (212B) extending at an obtuse outward angle downwardly therefrom. The second yoke (212) further comprises a pair of second yoke lower side members (212D) are each securely attached at a distal end of each of the second yoke side members (212C) extending at a right inward angle downwardly therefrom.

The second pipe jack clamp (210) further comprises a second threaded stem (214) is engageably mounted within the threaded opening. The second threaded stem (214) further comprises a second handle (216) securely attached at an upper distal end thereto, a second head (218) is rotatably mounted on a bottom distal end of the second threaded stem (214). The second head (218) comprises a configuration to secure a second work piece (222) in place. The configuration is a downward facing open V-shape.

The second pipejack clamp (210) further comprises a second pipe jack (220) comprises an upward V-configuration having complimentary configuration to an angle of the second yoke lower side members (212D). The second yoke (212) slidably engages the second pipe jack (220). A work piece (222) is positioned between the second yoke (212) and second pipe jack (220). The second work piece (222) is further positioned on top of the second pipe jack (220) and directly under the second yoke boss (212B).

The second pipe jack clamp (210) is manufactured from a material selected from a group consisting of metal, metal alloy, rubber, rubber composite, plastic, plastic composite, fiberglass, epoxy, and carbon-graphite.

It will be understood that each of the elements described above, or two or more together, may also find a useful application in other types of constructions differing from the type described above.

While the invention has been illustrated and described as embodied in a pipe jack clamp, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A first pipe jack clamp (110) comprising:

A) a first yoke (112) which comprises;

i) a first yoke cross member (112A), ii) a first yoke boss (112B) secured to an upper side middle of the first yoke cross member (112A), the first yoke boss (112B) and the first yoke cross member (112A) comprise a threaded opening therethrough, iii) a pair of first yoke side members (112C) are each securely attached at opposite distal ends of the first yoke boss (112B) extending at an obtuse outward angle downwardly therefrom, iv) a pair of first yoke lower side members (112D) are each securely attached at a distal end of each of the first yoke side members (112C) extending at a right inward angle downwardly therefrom;

B) a first threaded stem (114) is engageably mounted within the threaded opening, the first threaded stem (114) further comprises a first handle (116) securely attached at an upper distal end thereto, a first head (118) is rotatably mounted on a bottom distal end of the first threaded stem (114);

C) a first pipe jack (120) comprises an upward V-configuration having complimentary configuration to an angle of the first yoke lower side members (112D), the first yoke (112) slidably engages the first pipe jack (120), a work piece (122, 124) is positioned between the first yoke (112) and first pipe jack (120), the work piece (122, 124) is further positioned on top of the first pipe jack (120) and directly under the first yoke boss (112B).

2. The first pipe jack clamp (110) as described in claim 1 is manufactured from a material selected from a group consisting of metal, metal alloy, rubber, rubber composite, plastic, plastic composite, fiberglass, epoxy, and carbon-graphite.

3. The first pipe jack clamp (110) as described in claim 1, wherein the first head (118) comprises a configuration to secure a work piece (122, 124) in place.

4. The first pipe jack clamp (110) as described in claim 3, wherein the configuration is a downward facing open V-shape.

* * * * *